US007558396B2

(12) United States Patent
Liu et al.

(10) Patent No.: US 7,558,396 B2
(45) Date of Patent: Jul. 7, 2009

(54) MICROPHONE MODULE AT CORNER OR EDGE OF ELECTRONIC DEVICE

(75) Inventors: Han-Hsin Liu, Cupertino, CA (US); Kai Xu, Cupertino, CA (US); Ming Zhang, Cupertino, CA (US)

(73) Assignee: Fortemedia, Inc., Cupertino, CA (US)

( * ) Notice: Subject to any disclaimer, the term of this patent is extended or adjusted under 35 U.S.C. 154(b) by 170 days.

(21) Appl. No.: 11/532,117

(22) Filed: Sep. 15, 2006

(65) Prior Publication Data

US 2008/0069390 A1 Mar. 20, 2008

(51) Int. Cl.
*H04R 25/00* (2006.01)

(52) U.S. Cl. ..... 381/355; 381/356; 381/357

(58) Field of Classification Search ..... 381/91, 381/92, 313, 355, 356, 357, 358, 361, 365, 381/369; 379/430, 420.03, 433.03, 433.01
See application file for complete search history.

(56) References Cited

U.S. PATENT DOCUMENTS

| | | | | |
|---|---|---|---|---|
| 3,875,349 | A * | 4/1975 | Ruegg | 381/313 |
| 5,121,426 | A * | 6/1992 | Baumhauer et al. | 379/420.03 |
| 5,204,907 | A * | 4/1993 | Staple et al. | 381/91 |
| 6,327,370 | B1 | 12/2001 | Killion et al. | |
| 2001/0036266 | A1 * | 11/2001 | Gronroos et al. | 379/433.01 |

OTHER PUBLICATIONS

PCT Search report mailed Jul. 30, 2008.

* cited by examiner

*Primary Examiner*—Huyen D Le
(74) *Attorney, Agent, or Firm*—Thomas, Kayden, Horstemeyer & Risley

(57) ABSTRACT

An electronic device includes a body and a microphone module. The body includes a plurality of corners and a plurality of edges meeting at the corners. The microphone module is provided with a plurality of acoustic openings and disposed at the corners and/or the edges of the body to expose the acoustic openings.

6 Claims, 6 Drawing Sheets

MICROPHONE MODULE AT CORNER OR EDGE OF ELECTRONIC DEVICE

BACKGROUND OF THE INVENTION

1. Field of the Invention

The invention relates to a microphone module disposed at a corner, an edge, or both, of of an electronic device.

2. Description of the Related Art

Many consumer electronic products, e.g. cellular phones, personal digital assistants (PDAs), MP3 players, notebook computers, etc., have microphones inside. Consumer electronic products housings typically comprise plastic or metal, which are acoustic isolators, thus, housings typically comprise acoustic openings for microphones.

BRIEF SUMMARY OF THE INVENTION

The invention does not place microphones in the housing of an electronic product. Rather, the invention places a microphone module at a corner, an edge, or both, of the electronic product. Thus, the housing does not influence sound received by the microphone module.

Furthermore, in the invention, the microphones are integrated into a module. Mounting the microphone module on an electronic device is easy and fast.

The electronic device of the invention comprises a body and a microphone module. The body comprises a plurality of corners and a plurality of edges meeting at the corners. The microphone module comprises a plurality of acoustic openings, and is disposed at the corners, the edge, or both, of the body to expose the acoustic openings.

The microphone module comprises a uni-directional microphone and an omni-directional microphone disposed front-and-back or side-by-side.

The microphone module of the invention comprises a shell, a first boot, a second boot, a uni-directional microphone, and an omni-directional microphone. The shell comprises a first acoustic opening, a second acoustic opening, and a third acoustic opening. The first boot is disposed in the shell and comprises a fourth acoustic opening communicated with the first acoustic opening. The second boot is disposed in the shell and comprises a fifth acoustic opening and a sixth acoustic opening communicated with the second and third acoustic openings, respectively. The uni-directional microphone is disposed in the first boot, receiving near-end sound via the first and fourth acoustic openings. The omni-directional microphone is disposed in the second boot, receiving the near-end sound via the second and fifth acoustic openings as well as far-end sound via the third and sixth acoustic openings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
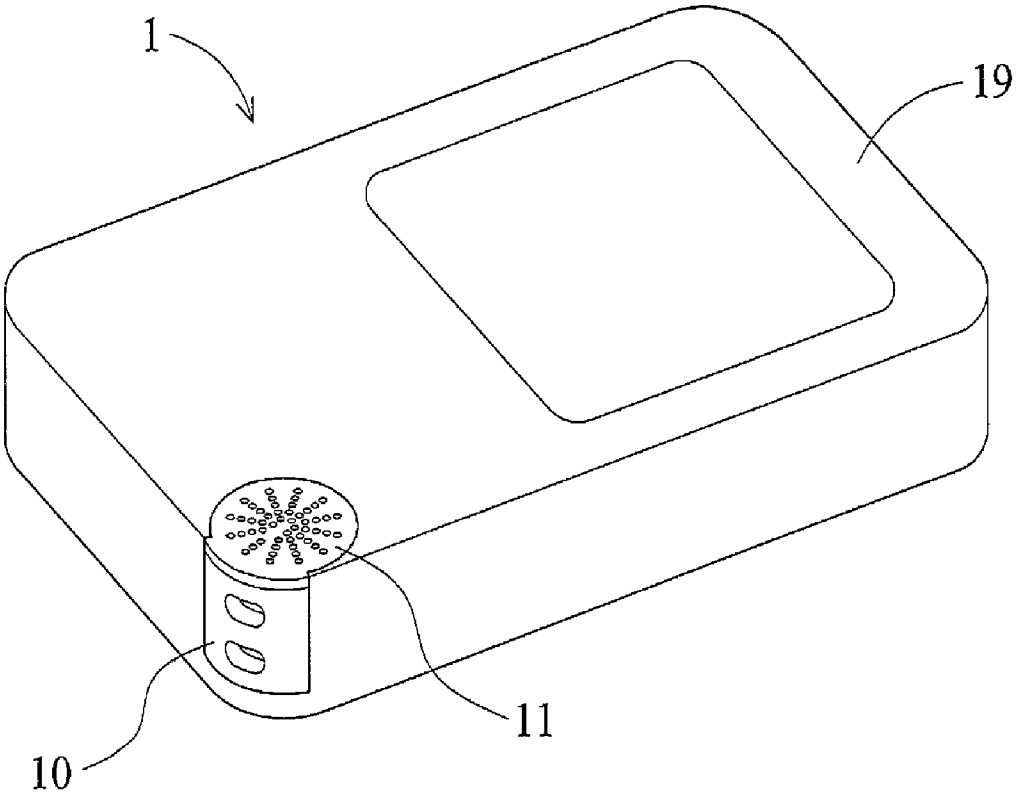
FIG. 1 depicts an electronic device in accordance with a first embodiment of the invention.

Referring to FIG. 1, an electronic device 1 of a first embodiment of the invention comprises a body 19 and a microphone module 10. The body 19 is substantially rectangular and has four corners and four edges meeting at the corners. The microphone module 10 is disposed at a corner of the body 19.

Figure 2:
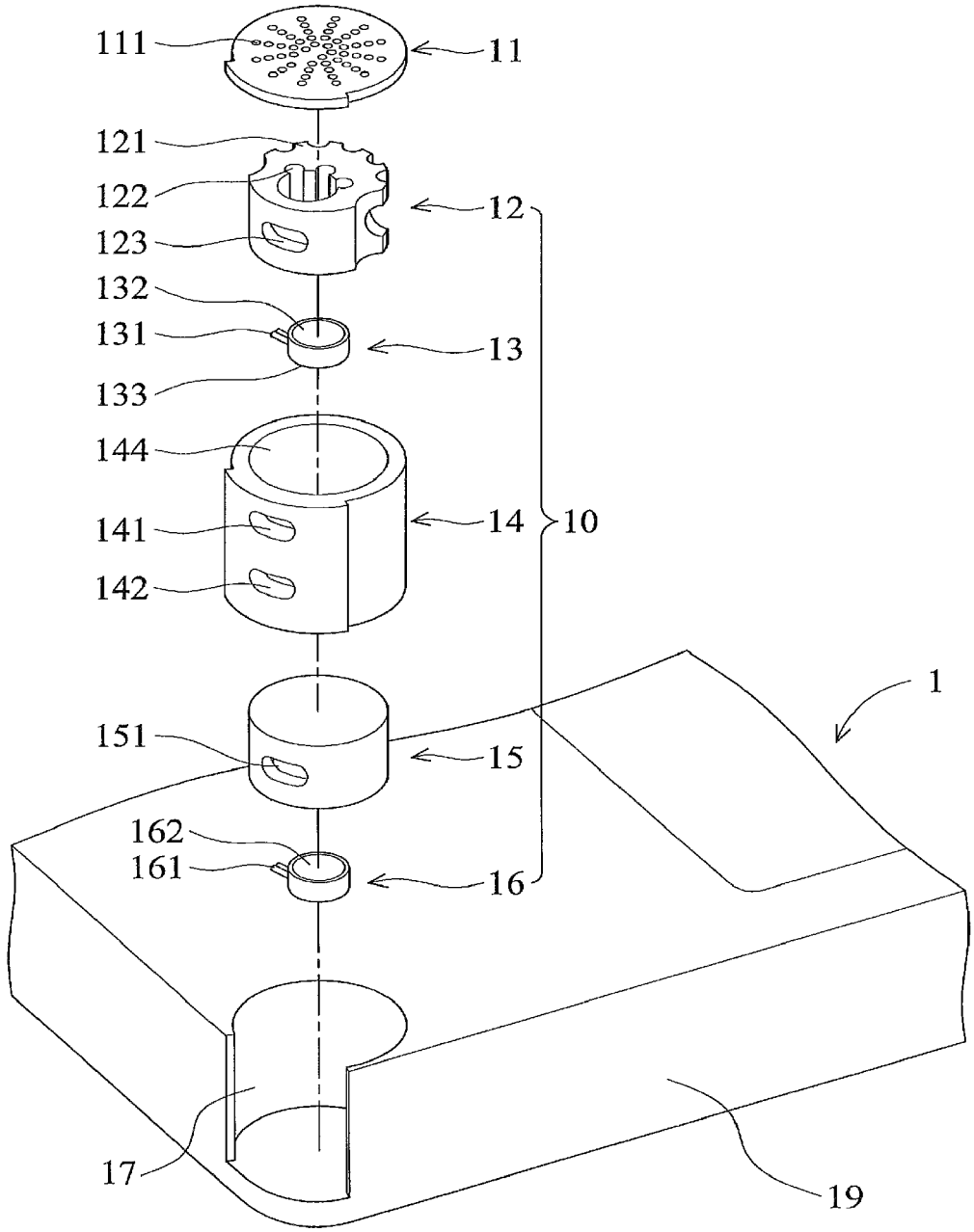
FIG. 2 is an exploded diagram of the microphone module in accordance with the first embodiment of the invention.
Figure 3:
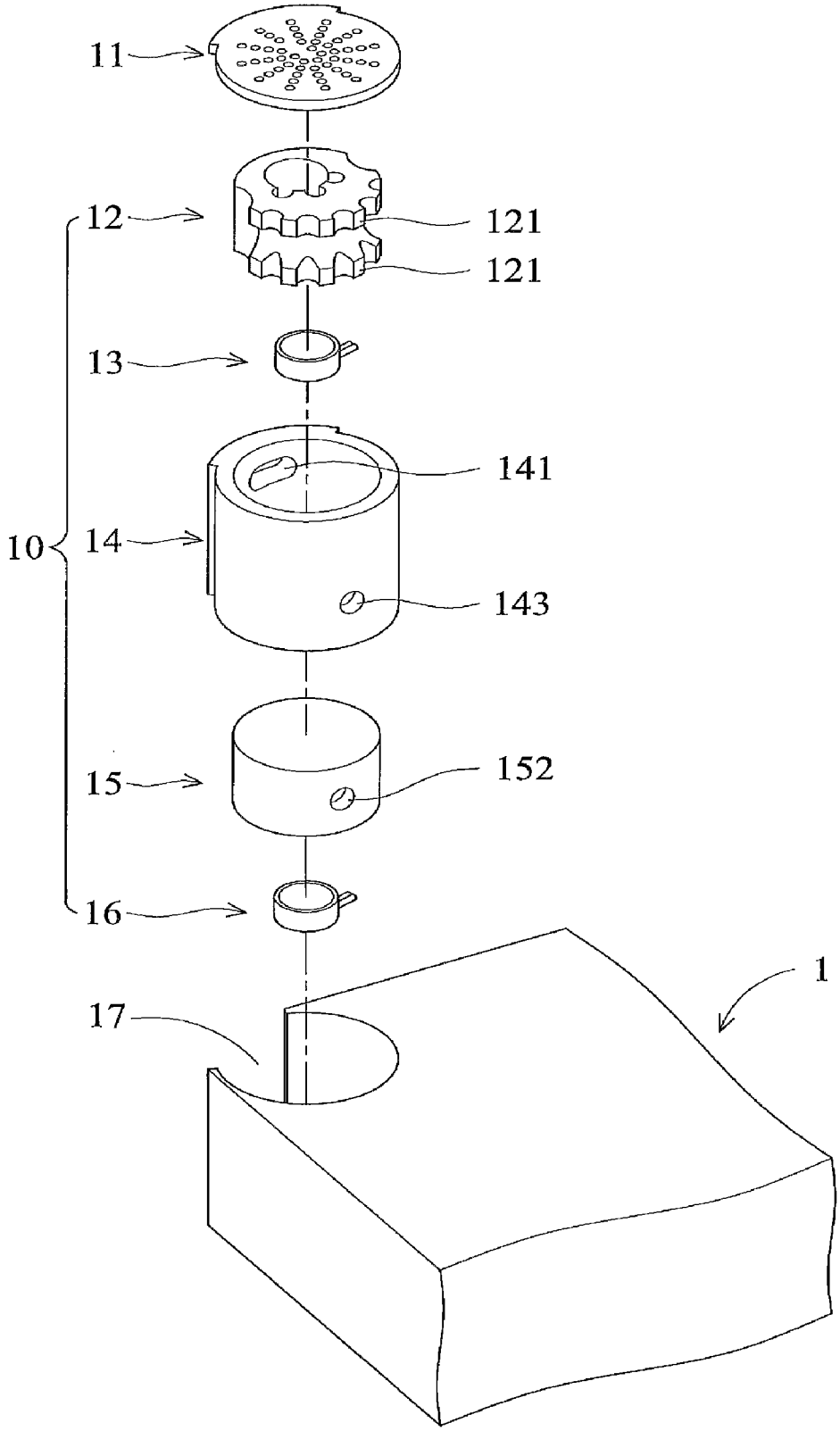
FIG. 3 is an exploded diagram of the microphone module in accordance with the first embodiment of the invention, observed in another direction.

Referring to FIGS. 2 and 3, the microphone module 10 comprises a first boot 12, a uni-directional microphone 13, a shell 14, a second boot 15, and an omni-directional microphone 16.

The shell 14 comprises acoustic isolation materials (e.g. acrylonitrile-butadiene-styrene copolymers, ABS plastic). The interior of the shell 14 is divided into an upper space 144, for receiving the first boot 12 and the uni-directional microphone 13, and a lower space (not shown) for receiving the second boot 15 and the omni-directional microphone 16. Transition of sound between the upper and lower spaces is prevented because the shell 14 comprises acoustic isolation materials. The shell 14 comprises a first acoustic opening 141, a second acoustic opening 142, and a third acoustic opening 143.

The first boot 12 comprises anti-vibration materials (e.g. rubber). Furthermore, the first boot 12 has a fourth acoustic opening 123 and a plurality of acoustic grooves 122. The acoustic grooves 122 longitudinally extend on the inner walls of the first boot 12. During assembly of the microphone module 10, the first boot 12 is squeezed into the upper space 144 of the shell 14 with the fourth acoustic opening 123 communicating with the first acoustic opening 141. Note that the first boot 12 comprises a plurality of protrusions 121 at its outer edges abutting the shell 14 for enhancing the vibration absorption.

The uni-directional microphone 13 is squeezed into the first boot 12 and located higher than the fourth acoustic opening 123. Reference numeral 131 designates the signal wires of the uni-directional microphone 13. It is understood that the first boot 12 and the shell 14 comprise additional openings (not shown) for the signal wires 131 to pass through.

The second boot 15 also comprises anti-vibration materials (e.g. rubber). Furthermore, the second boot 15 has a fifth acoustic opening 151 and a sixth acoustic opening 152. During assembly of the microphone module 10, the second boot 15 is squeezed into the lower space (not shown) of the shell 14 with the fifth and sixth acoustic openings 151 and 152 communicating with the second and third acoustic openings 142 and 143, respectively.

The omni-directional microphone 16 is squeezed into the second boot 15 and located lower than the fifth acoustic opening 151. Reference numeral 161 designates the signal wires of the omni-directional microphone 16. Similarly, the second boot 15 and the shell 14 comprise additional openings (not shown) for signal wires 161 to pass through.

From the described it is understood that the uni-directional microphone 13 and the omni-directional microphone 16 are disposed front-and-back in the first embodiment.

A hole 17 is provided at a corner of the body 19 to receive the microphone module 10. A cover 11 covers the microphone module 10 for decoration. The cover 11 comprises a plurality of seventh acoustic openings 111.

The uni-directional microphone 13 in the microphone module 10 receives near-end sound propagating in three paths: (I) the sound waves enter via the seventh acoustic opening 111 and contact the top 132 of the uni-directional microphone 13; (II) the sound waves enter via the first and fourth acoustic openings 141 and 123 and contact the bottom 133 of the uni-directional microphone 13; and (III) the sound waves enter via the seven acoustic opening 111, propagate through the acoustic grooves 122, and contact the bottom 133 of the uni-directional microphone 13.

The omni-directional microphone 15 in the microphone module 10 simultaneously receives near-end sound and far-end sound. In operation, the near-end sound waves enter via the second and fifth acoustic openings 142 and 151 and contact the top 162 of the omni-directional microphone 16. The far-end sound comes from a speaker (not shown) disposed in the body 19. In operation, the far-end sound waves enter via the third and sixth acoustic openings 143 and 152 and contact the top 162 of the omni-directional microphone 16.

Figure 4:
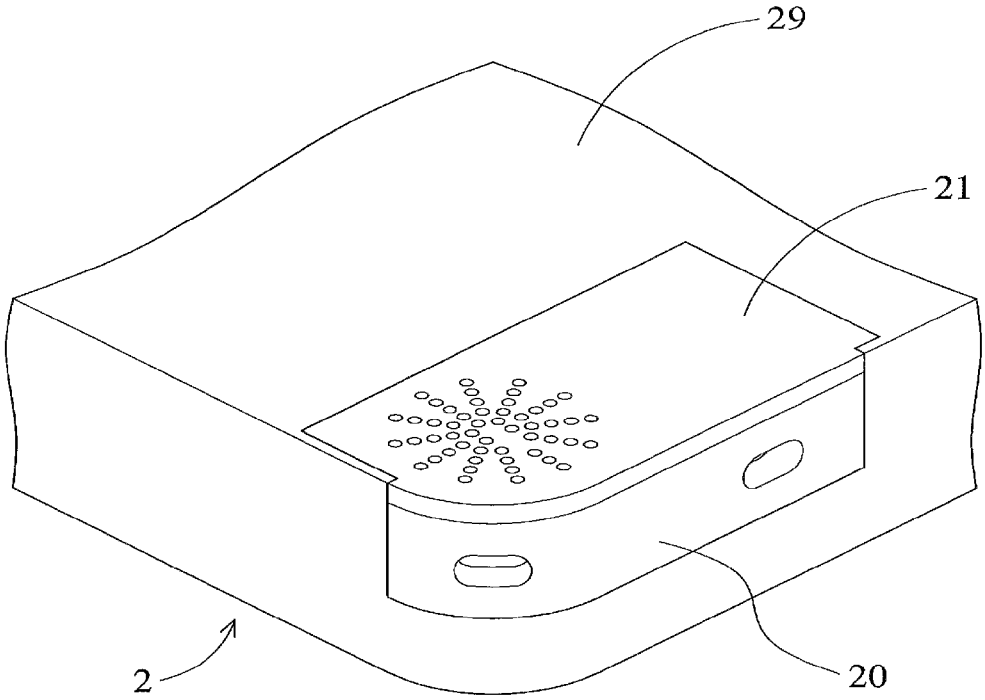
FIG. 4 depicts an electronic device in accordance with a second embodiment of the invention.

Referring to FIG. 4, an electronic device 2 of a second embodiment of the invention comprises a body 29 and a microphone module 20. The microphone module 20 is disposed at a corner or an edge of the body 29.

Figure 5:
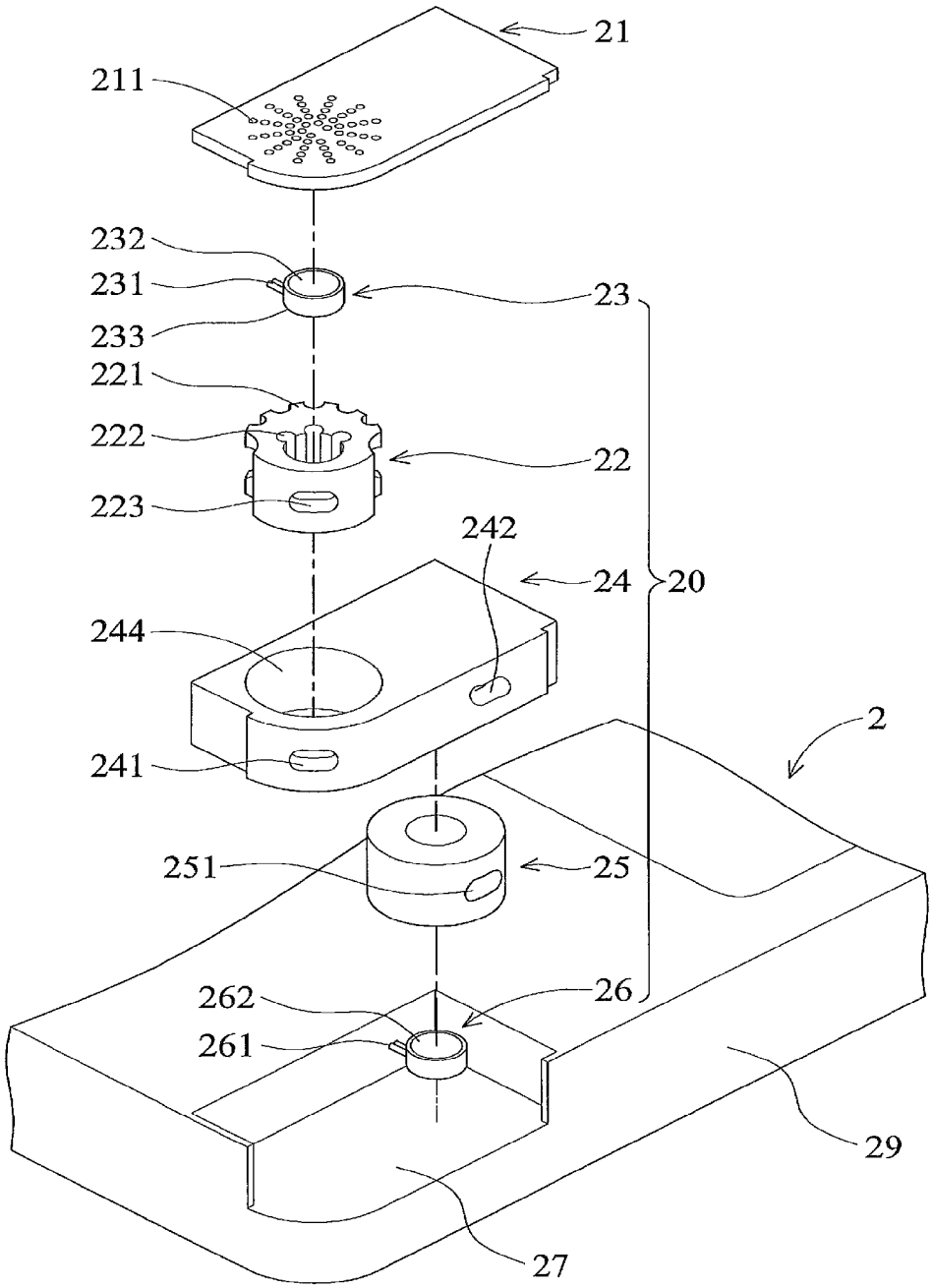
FIG. 5 is an exploded diagram of the microphone module in accordance with the second embodiment of the invention.
Figure 6:
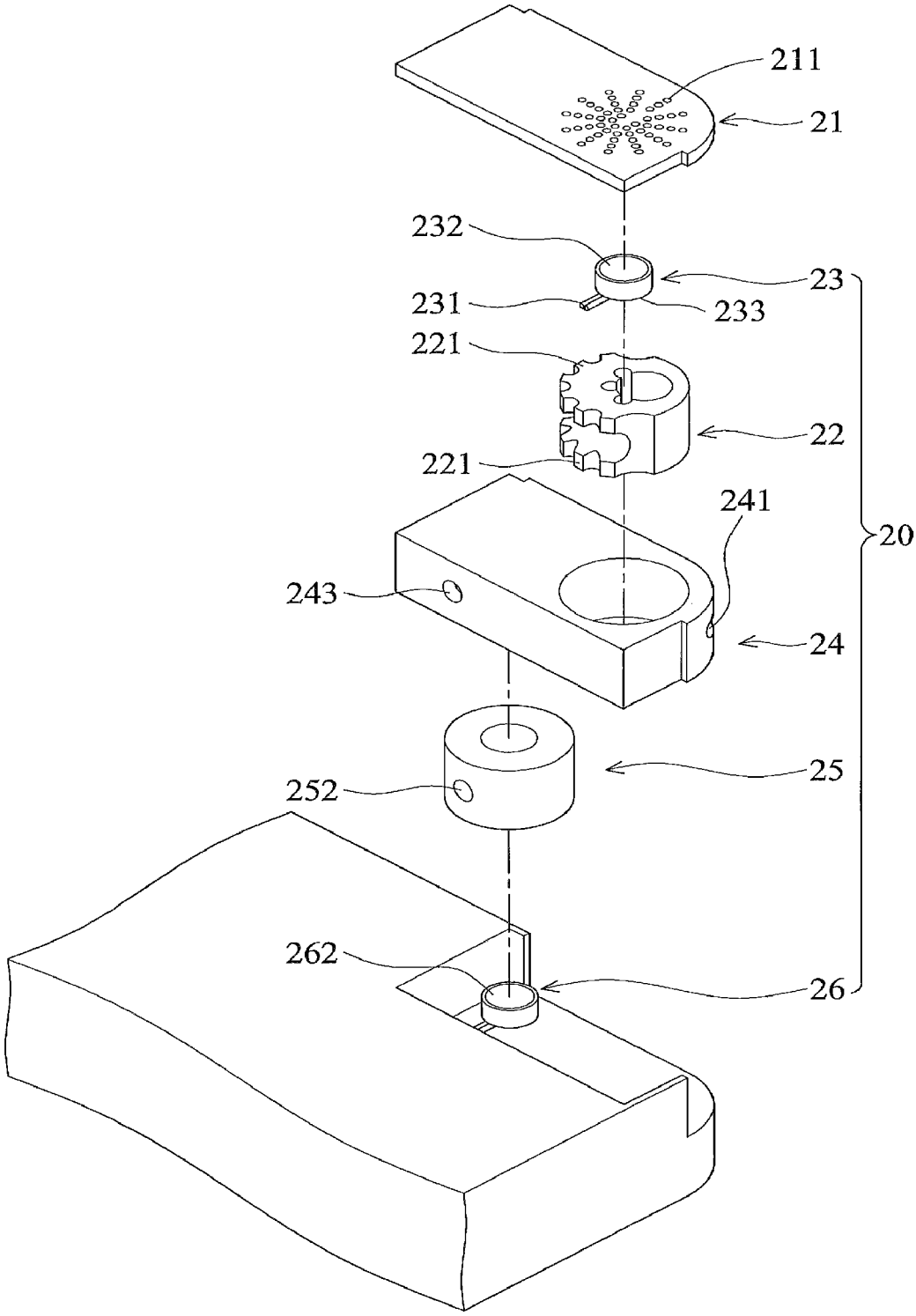
FIG. 6 is an exploded diagram of the microphone module in accordance with the second embodiment of the invention, observed from another direction.

Referring to FIGS. 5 and 6, the microphone module 20 comprises a first boot 22, a uni-directional microphone 23, a shell 24, a second boot 25, and an omni-directional microphone 26.

The shell 24 comprises acoustic isolation materials (e.g. acrylonitrile-butadiene-styrene copolymers, ABS plastic). The shell 24 comprises two spaces: a left space 244 for receiving the first boot 22 and the uni-directional microphone 23, and a right space (not shown) for receiving the second boot 25 and the omni-directional microphone 26. Transition of sound between the left and right spaces is prevented because the shell 24 comprises acoustic isolation materials. Furthermore, the shell 24 comprises a first acoustic opening 241, a second acoustic opening 242, and a third acoustic opening 243.

The first boot 22 comprises anti-vibration materials (e.g. rubber). Furthermore, the first boot 22 has a fourth acoustic opening 223 and a plurality of acoustic grooves 222. The acoustic grooves 222 longitudinally extend on the inner walls of the first boot 22. During assembly of the microphone module 20, the first boot 22 is squeezed into the left space 244 of the shell 24 with the fourth acoustic opening 223 communicating with the first acoustic opening 241. Note that the first boot 22 has a plurality of protrusions 221 at its outer edges abutting the shell 24, for enhancing the vibration absorption.

The uni-directional microphone 23 is squeezed into the first boot 22 and located higher than the fourth acoustic opening 223. Reference numeral 231 designates the signal wires of the uni-directional microphone 23. It is understood that the first boot 22 and the shell 24 have additional openings (not shown) for the signal wires 231 to pass through.

The second boot 25 also comprises anti-vibration materials (e.g. rubber). The second boot 25 has a fifth acoustic opening 251 and a sixth acoustic opening 252. During assembly of the microphone module 20, the second boot 25 is squeezed into the right space (not shown) of the shell 24 with the fifth and sixth acoustic openings 251 and 252 communicating with the second and third acoustic openings 242 and 243, respectively.

The omni-directional microphone 26 is squeezed into the second boot 25 and located lower than the fifth acoustic opening 251. Reference numeral 261 designates the signal wires of the omni-directional microphone 26. Similarly, the second boot 25 and the shell 24 comprise additional openings (not shown) for the signal wires 261 to pass through.

From the above descriptions, it is understood that the uni-directional microphone 23 and the omni-directional microphone 26 are disposed side-by-side in the second embodiment.

A hole 27 is provided at a corner, an edge, or both, of the body 29 to receive the microphone module 20. A cover 21 covers the microphone module 20 for esthetics. The cover 21 comprises a plurality of seventh acoustic openings 211.

The uni-directional microphone 23 in the microphone module 20 receives near-end sound propagating in three paths: (I) the sound waves enter via the seventh acoustic opening 211 and contact the top 232 of the uni-directional microphone 23; (II) the sound waves enter via the first and fourth acoustic openings 241 and 223 and contact the bottom 233 of the uni-directional microphone 23; and (III) the sound waves enter via the seven acoustic opening 211, propagate through the acoustic grooves 222, and contact the bottom 233 of the uni-directional microphone 23.

The omni-directional microphone 25 in the microphone module 20 simultaneously receives near-end sound and far-end sound. In operation, the near-end sound waves enter via the second and fifth acoustic openings 242 and 251 and contact the top 262 of the omni-directional microphone 26. The far-end sound waves enter via the third and sixth acoustic openings 243 and 252 and contact the top 262 of the omni-directional microphone 26.

The invention does not place microphones in the housing of an electronic product. Rather, the invention places a microphone module at a corner and/or an edge of the electronic product to expose the acoustic openings. Thus, the housing does not influence sound received by the microphone module. Furthermore, in the invention, the microphones are integrated into a module. Mounting the microphone module on an electronic device is easy and fast.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microphone module, comprising:

a shell provided with a first acoustic opening, a second acoustic opening, and a third acoustic opening;

a first boot disposed in the shell and provided with a fourth acoustic opening communicating with the first acoustic opening;

a uni-directional microphone disposed in the first boot, receiving near-end sound via the first and fourth acoustic openings;

a second boot disposed in the shell and provided with a fifth acoustic opening and a sixth acoustic opening communicating with the second and third acoustic openings, respectively;

an omni-directional microphone disposed in the second boot, receiving the near-end sound via the second and fifth acoustic openings as well as far-end sound via the third and sixth acoustic openings.

2. The microphone module as claimed in claim 1, wherein the first boot comprises inner walls with at least one acoustic groove provided thereon, for the uni-directional microphone to receive the near-end sound.

3. The microphone module as claimed in claim 1, wherein the first boot comprises at least one protrusion abutting on the shell.

4. The microphone module as claimed in claim 1, wherein the first boot comprises rubber.

5. The microphone module as claimed in claim 1, wherein the shell is further provided a first space receiving the first boot and the uni-directional microphone as well as a second space receiving the second boot and the omni-directional microphone, and the first space and the second space are acoustically isolated from each other.

6. The microphone module as claimed in claim 1, wherein the shell comprises acrylonitrile-butadiene-styrene copolymers.

* * * * *